United States Patent [19]

Morita et al.

[11] Patent Number: 4,968,574

[45] Date of Patent: Nov. 6, 1990

[54] TONER FOR ELECTROPHOTOGRAPHY

[75] Inventors: Hideaki Morita; Takahira Kasuya; Goichi Yamakawa; Makoto Tomono, all of Hachioji; Hirozo Funaki, Shiga; Minoru Kohara, Kyoto, all of Japan

[73] Assignees: Sekisui Chemical Co., Ltd.; Konishiroku Photo Industry Co., Ltd., both of Japan

[21] Appl. No.: 817,768

[22] Filed: Jan. 9, 1986

Related U.S. Application Data

[63] Continuation of Ser. No. 451,384, Dec. 20, 1982, abandoned, which is a continuation of Ser. No. 260,817, May 5, 1981, abandoned.

[30] Foreign Application Priority Data

May 13, 1980 [JP] Japan ..... 55-62207

[51] Int. Cl.[5] ..... G03G 9/087

[52] U.S. Cl. ..... 430/109; 430/111

[58] Field of Search ..... 430/109, 111

[56] References Cited

U.S. PATENT DOCUMENTS

| | | | |
|---|---|---|---|
| 3,753,909 | 8/1973 | Hulse | 430/109 |
| 3,764,538 | 10/1973 | Shelffo | 430/109 |
| 3,965,021 | 6/1976 | Clemens | 430/109 |
| 4,385,107 | 5/1983 | Tanaka et al. | 430/109 |
| 4,386,147 | 5/1983 | Seimiya et al. | 430/109 |
| 4,486,524 | 12/1984 | Fujisaki et al. | 430/109 |

FOREIGN PATENT DOCUMENTS

| | | | |
|---|---|---|---|
| 1495428 | 12/1977 | United Kingdom | 430/109 |

*Primary Examiner*—John L. Goodrow

*Attorney, Agent, or Firm*—Jordan B. Bierman

[57] ABSTRACT

The present invention relates to toners for electrophotography wherein the main resin component comprises a lower molecular weight polymer and a higher molecular weight polymer each of which is different from the other wherein the higher molecular weight polymer has a glass transition point of at least 50° C. and the lower molecular weight polymer has a glass transition point no higher than 65° C. The above polymers comprise one or more polymers selected from styrene polymers, arcylic polymers, and styrene-acrylic copolymers. Generally, the lower molecular weight polymer has a weight average molecular weight of 50,000 or less and the higher molecular weight polymer has a weight average molecular weight of 80,000 or more.

3 Claims, No Drawings

TONER FOR ELECTROPHOTOGRAPHY

This is a continuation of Ser. No. 451,384, filed 12-20-82, now abandoned, which is a continuation of Ser. No. 260,817, filed May 5, 1981, now abandoned.

The present invention relates to toner that is used for development from electrostatic latent images formed by electrophotography, electrostatic printing, electrostatic recording, etc.

Generally, toner that is a kind of fine grained binder resin loaded with a coloring agent, etc. is used to develop visible toner images from electrostatic latent images. Toner images thus developed must be fixed on their base. Various fixing methods are known for this purpose, among which, particularly, the contact type heat fixing method that uses a hot roll fixing device or the like is preferable, for it is superior to the noncontact type heat fixing method that uses a hot plate fixing device or the like because of a higher thermal efficiency of the former and, particularly, it provides a highspeed fixing performance.

To provide toner that can be fixed by the contact type heat fixing method, it is believed preferable to formulate the binder resin of toner so it is composed of both a lower molecular weight polymer ingredient that endows toner with a positive softening performance at an elevated temperature for fixing and a higher molecular weight polymer ingredient necessary to prevent the offset phenomenon that results from partial sticking of toner to the surface of hot roll. For example, Japanese Patent Publication Open to Public Inspection (hereinafter referred to as Japanese Patent O.P.I. Publication) No. 134652/1975 disclosed toner that used a mixture of lower and higher molecular weight ingredients of styrene-acrylic polymer while Japanese Patent O.P.I. Publication No. 114245/1979 disclosed toner that used a mixture of a lower molecular weight styrene-acrylic polymer ingredient and a higher molecular weight styrene-butadiene polymer ingredient.

However, all toner types heretofore disclosed that are loaded with such a higher molecular weight polymer ingredient as mentioned above have difficulties in their practical use, for because of their inclusion of a higher molecular weight polymer ingredient they have higher softening points, for example, in comparison to the ones that are fixed by the noncontact type heat fixing method that makes use of a hot plate fixing device, etc. and, therefore, they require the hot roll to be set to a fairly high temperature, which results in difficulties, such as more consumption of energy, prolonged preheating time, and shorter service life of the fixing device.

The problem is that any attempt to avoid the above difficulties by selecting and adjusting the binder resin in its kind, formulation or molecular weight for a lower softening point necessarily results in lowering of the glass transition point of the binder resin and thereby the lower limit to temperatures at which the product toner coheres, so the toner becomes liable to cohere getting no more available for use while being stocked or used in the developing device. In view of the cohesion of toner grains, the lower limit to the glass transition point that can generally be admitted for the binder resin is 55° C. and preferably 55° C.

In short, in the past, even though the toner could be endowed with an offset-free performance by composing its binder resin from lower and higher molecular weight polymer ingredients, it failed to have both of two contradictory properties, or a low softening point and a high glass transition point simultaneously. The fact is thus that no toner that is available simultaneously exhibits both a high fixing performance with the contact type heat fixing method and a cohesion-free performance during storage.

Accordingly, it is an object of the present invention to provide toner for development from electrostatic latent images that has a low softening point being very suitable for fixing with the contact type heat fixing method and yet does not cohere below a certain critical temperature that is high enough by composing the base compound of its binder resin from a lower molecular weight polymer ingredient (hereinafter referred to as "ingredient L") and a higher molecular weight polymer ingredient (hereinafter referred to as "ingredient H") and controlling or specifying the type (or formulation) of the polymer compound comprising each of the ingredients L and H and glass transition points for both of the ingredients as well as the base compound.

The above and other objects of the present invention can be achieved by formulating the binder resin with use of a base compound composed of ingredients L and H, which are individually composed of one or more polymer types selected from a group of compounds comprising styrene polymers, acrylic polymers and styrene-acrylic copolymers but different from each other in formulation wherein the ingredients L and H have a glass transition point of 50° C. or over and 65° C. or under, respectively, while the base resin has a glass transition point of 50° C. or over.

Styrene polymers, acrylic polymers and styrene-acrylic polymers that may be used for the ingredients L and H in the present invention can be composed, for example, of the following monomers: styrene, o-methylstyrene, m-methylstyrene, p-methylstyrene, α-methylstyrene, p-ethylstyrene, 2,4-dimethylstyrene, p-n-butylstyrene, p-dodecylstyrene, p-methoxystyrene, p-phenylstyrene, p-chlorostyrene, methylacrylate, ethyl acrylate, n-butyl acrylate, 2-ethylhexyl acrylate, lauryl acrylate, stearyl acrylate, methyl methacrylate, ethyl methacrylate, n-propyl methacrylate, n-butyl methacrylate, tert-butyl methacrylate, 2-ethylhexyl methacrylate, lauryl methacrylate, stearyl methacrylate, cyclohexyl methacrylate, 2-hydroxyethyl methacrylate, glycidyl methacrylate, dimethylaminoethyl methacrylate, etc. These monomers can be used independently or several of them may be mixed to provide a polymer compound. It is noted, however, that the glass transition point of the ingredient H used in the present invention must always be kept at 65° C. or under and preferably at 55° C. or under, so a monomer or monomers that provide a softer polymer compound must be used in a higher proportion. The glass transition point of separate polymers that are individually composed of these monomers is given in various literature. For example, a group of monomers whose individual polymers exhibit a glass transition point around 100° C. include styrene, methyl methacrylate, tert-butyl methacrylate, etc., another group of monomers whose individual polymers exhibit a glass transition point around 60° C. include ethyl methacrylate, cyclohexyl methacrylate, 2-hydroxyethyl methacrylate, etc., another group of monomers whose individual polymers exhibit a glass transition point around 20° C. include n-tetradecyl acrylate, n-butyl methacrylate, dimethylaminoethyl methacrylate, etc., and still another group of monomers whose individual polymers exhibit a glass transition point around −60° C. include n-propyl acrylate, n-butyl acrylate, lauryl methacrylate, etc. In the present invention, if several monomers are mixed to get the ingredient H, a rough estimate of glass transition point for that ingredient can be given by calculating the weighted mean of glass transition point (absolute temperature) between individual polymers of these monomers using the weight fraction of each monomer as its weighting factor. These informations will allow to properly select a monomer or monomers that can provide the ingredient H as mentioned above.

Meanwhile, a monomer or monomers used to prepare the ingredient L of the present invention can also be properly selected from styrene monomers and acrylic monomers. However, it is noted that the glass transition point of this ingredient must be kept at 50° C. or over, so a monomer or monomers that provide a harder polymer compound must be used in a higher proportion. It is generally known that usually the glass transition point of a polymer lowers with its molecular weight when such molecular weight is below a certain critical level. Such lowering of the glass transition point with the molecular weight is also observed with the ingredient L used in the present invention, so to keep the glass transition point above 50° C. and preferably above 55° C. it is necessary to use a monomer or monomers that provide a harder polymer compound in a higher proportion as mentioned above.

It is known from the above that the ingredients L and H used in the present invention are provided of themselves in a monomer formulation different from each other. For such monomer formulation, selection can be made from styrene monomers and acrylic monomers at discretion as far as the polymer compounds of the ingredients H and L have a glass transition point of 65° C. or under and 50° C. or over, respectively, while the base resin as composed of both of these ingredients has a glass transition point of 50° C. or over.

It is noted that in the present invention the "glass transition point" of a polymer compound is defined as a value determined with the compound using a differential scanning calorimeter under the condition as described below.

20±5 mg of a fine powdered sample of the polymer compound in consideration is put into an aluminium pan and it is heated from 0° C. at a rate of 10° C./min to measure the absorption peak due to glass transition of the sample. The measured data are plotted to estimate the temperature at which the glass transition has started or the glass transition point by extrapolation. For the temperature correction, indium is used, whose melting point (temperature at which the metal starts melting) is assumed 154° C. when estimated similarly by extrapolation.

In the present invention, it is assumed that the above ingredients L and H have a weight average molecular weight of 50,000 or under and 80,000 or over, respectively. Further, it is desirable to adjust the ratio of the weight average molecular weight Mw to the number average molecular weight Mn of the above base resin of the present invention or Mw/Mn to 3.5 or over by properly selecting and compounding its ingredients in type, composition, molecular weight and mixing ratio. It is noted that the above numerical figures given for the limit to allowable molecular weights both refer to values determined by gel permeation chromatography under the following condition. Namely, while solvent tetrahydrofuran is passed across a chromato-column at a rate of 1 ml/min at a temperature of 25° C., 8 mg of the sample dissolved in tetrahydrofuran at a concentration of 0.4 g/dl is injected for elution and counting. The measuring condition is so selected that the molecular distribution of the sample compound may be covered within a linear range of a calibration curve that is obtained by plotting the logarithm of the molecular weight of several standard samples of monodisperse polystyrene vs. their count. The reliability of the above measurement is checked by confirming that the ratio Mw/Mn is estimated to 2.11±0.10 for the standard polystyrene sample NBS706 (weight average molecular weight $Mw=28.8\times10^4$ and Mw/Mn=2.11).

The base resin used in the present invention can be prepared by an arbitrary process as far as the product resin is endowed with the characteristic properties as mentioned above. For example, a process can be used by which a polymer compound that comprises either the ingredient L or H is prepared by the first stage of polymerization reaction and the product polymer compound is then dissolved in a monomer composition that can give a second polymer compound comprising the other ingredient to conduct the second stage of polymerization reaction to prepare such second polymer compound.

The binder resin used in the present invention contains a base resin composed of ingredients L and H, each composed of a polymer compound selected from styrene polymers, acrylic polymers and styrene-acrylic copolymers. However, for improvements of performances, such as more stabilized friction charging and easier crushability, above binder resin can be loaded, as necessary, with an additional resin or resins that are ordinarily used as binder in toner for development from electrostatic latent images. Examples of such additional resins are rosin-modified phenol-formaldehyde resin, epoxy resin, polyurethane resin, cellulose resin, polyether resin, polyester resin, styrene-butadiene resin, and styrene resin, acrylic resin and styrene-acrylic resin other than the type used for the aforementioned ingredients L and H. These resins may be added in a quantity that do not impair the objects or features of the present invention. This quantity is about 30 wt-% or under of the entire binder resin.

The ingredients L and H as mentioned above can be prepared by the solution polymerization process, bulk polymerization process, etc. However, it is noted that as stated before the weight average molecular weight must be 50,000 or under for the ingredient L and 80,000 or over for the ingredient H. The above requirements for the weight average molecular weight can be satisfied in a familiar way, for example, by selecting the kind and quantity of the polymerization initiator and/or chain transfer agent and adjusting the temperature of polymerization reaction, etc.

In toner for development from electrostatic latent images of the present invention, the binder polymer compound as mentioned above may be arbitrarily loaded with a proper pigment or dye type coloring agent. Examples of proper pigments and dyes are carbon black, nigrosine dye (C.I. No. 50415B), aniline blue (C.I. No. 50405), calcoil blue (C.I. No. azoec Blue 3), chrome yellow (C.I. No. 14090), ultramarine blue (C.I. No. 77103), Du Pont oil red (C.I. No. 26105), orient oil red #330 (C.I. No. 60505), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), rose bengale (C.I. No. 45435), etc. They may be used independently or in combination. This coloring agent must be added in a quantity that is enough to develop satisfactory visible images. Ordinarily, the quantity is selected in a range from 1 to 20 parts by weight per 100 parts by weight of the binder polymer compound.

As stated later, one of the characteristic properties which toner for development from electrostatic latent images of the present invention is endowed with is the offset-free performance or a performance that suppresses generation of the offset phenomenon on fixing that is conducted by the hot roll fixing device or the like. To improve this offset-free performance further, toner may be loaded with a substance that has a parting property, as necessary.

Since toner of the present invention is prepared as stated above with its binder resin composed of a base resin that is composed of ingredients L and H, its positive fixing performance is assured by the ingredient L while its offset-free performance is attained under an action of the ingredient H, so it can be fixed favorably and positively by the contact type heat fixing method with use of the hot roll fixing device or the like. Further, the glass transition point of the ingredient H is set to 65° C. or under and preferably to 55° C. or under, the softening point of the binder resin on the whole can be lowered substantially. Moreover, since the glass transition point of the base resin such binder resin is composed of is set to 50° C. or over and preferably to 55° C. or over, the temperature at which toner of the present invention starts cohesion is elevated, so no cohesion occurs with this toner when it is stocked or used under ordinary conditions.

An example of the correlation of the glass transition point vs. cohesion of this type of toner is given in FIG. 3 of the abstract of papers for "Second International Conference on Electrophotography", p.97.

As stated above, toner of the present invention has attained a lower softening point as compared to the former ones while maintaining its fixing performance, offset-free performance and cohesion-free performance. Thus, if it is used, for example, the fixing device can fix images at a lower fixing temperature and at a higher rate requiring a shorter time for warming up. This means that toner capable of saving the copy cost can be provided. It is noted that the present invention can be applied also to the single component type toner or monotoner that is loaded with magnetic powder.

The invention will be understood more readily by reference to the following examples, though these examples are intended to illustrate the invention and are not to be construed to limit the scope of the invention. It is noted that the term "parts by weight" is abbreviated "parts" in the examples:

EXAMPLE 1

Preparation of Binder Resin 0.1 g of partially saponified polyvinyl alcohol "Gosenol GH-17" (supplier: Nippon Synthetic Chemical Industry) was put into a 1 liter separable flask and dissolved there in 100 ml of distilled water. A monomer mixture A as formulated in Table 1 was added thereto for dispersion and suspension. After the gaseous phase was replaced with nitrogen gas, the solution was heated to 80° C. and kept at this temperature for 15 hrs to conduct the first stage of polymerization reaction Thereafter, the reaction mixture was cooled down to 40° C. and after addition of another monomer mixture B also formulated in Table 1 it was agitated for 2 hrs at this temperature. After dropwise addition of a solution that was separately prepared by dissolving 0.4 g of "Gosenol GH-17" in 100 ml of distilled water, the mixture was reheated to 80° C. and kept at this temperature for 8 hours, and it was then further heated to 95° C. and kept at this temperature for 2 hrs to complete the second stage of polymerization reaction. The mixture was then cooled down to separate solid products, which were dried after repeated dehydration and rinse to give a polymer compound composed of the ingredients L and H. With this polymer compound, the weight average molecular weight Mw was estimated to 71,000, the ratio Mw/Mn to 7.5, the glass transition point to 67° C. and the softening point to 123° C. It is noted that when the above monomer mixture A was polymerized alone under the same condition as applied to the first stage of polymerization reaction the weight average molecular weight Mw of the product higher molecular weight polymer compound "a" was estimated to 350,000 and its glass transition point to 48° C. while when the monomer mixture B was polymerized alone under the same condition as applied to the second stage of polymerization reaction the weight average molecular weight Mw of the product lower molecular weight polymer compound "b" was estimated to 16,000 and its glass transition point to 70° C.

TABLE 1

| | Monomer Mixture A | Monomer Mixture B |
|---|---|---|
| Styrene | 15 g (75 parts) | 85 g (85 parts) |
| n-butyl acrylate | 5 g (25 parts) | — |
| n-butyl methacrylate | — | 15 g (15 parts) |
| Benzoyl peroxide | 0.04 g (0.2 parts) | 4 g (4 parts) |

Preparation of Toner 100 parts of the polymer compound prepared as above, 10 parts of carbon black, and 2 parts of nigrosine base EX (C.I. No. 50415B) were mixed. The mixture was grounded for dispersion in a ball mill for 24 hrs and then kneaded under a hot roll. After cooling, the mixture was crushed and pulverized to produce toner of the present invention or "Sample 1" having a mean grain size of 13 to 15u.

EXAMPLE 2

30 g of a monomer mixture that was composed of 65 parts of styrene and 35 parts of 2-ethylhexyl methacrylate in formulatation and capable of producing a polymer compound of ingredient H having a weight average molecular weight of 300,000 and a glass transition point of 53° C. at the separate state thereof and 100 g of a monomer mixture that was composed of 95 parts of styrene and 5 parts of n-butyl methacrylate in formulation and capable of producing a polymer compound of ingredient L having a weight average molecular weight of 6,000 and a glass transition point of 63° C. at the separate state thereof were used for polymerization according to the method as used in Example 1 to obtain a polymer compound having a weight average molecular weight of 74,000, a ratio Mw/Mn of 1.90, a glass transition point of 60° C. and a softening point of 118° C.

The polymer compound was used for the binder resin to prepare another toner of the present invention or "Sample 2" by the same method as applied to the preparation of toner in Example 1.

EXAMPLE 3

50 g of a monomer mixture that was composed of 70 parts of styrene, 20 parts of ethyl acrylate and 10 parts of n-butyl acrtylate and capable of producing a polymer compound of ingredient H having a weight average molecular weight of 230,000 and a glass transition point of 47° C. at the separate state thereof and 100 g of a monomer mixture that was composed of 80 parts of styrene, 15 parts of α-methylstyrene and 5 parts of methyl acrylate and capable of producing a polymer compound of ingredient L having a weight average molecular weight of 4,500 and a glass transition point of 65° C. at the separate state thereof were used for polymerization according to the method as used in Example 1 to obtain a polymer compound having a weight average molecular weight of 80,000, a ratio Mw/Mn of 24.0, a glass transition point of 58° C. and a softening point of 112° C.

The polymer compound was used for the binder resin to prepare another toner of the present invention or "Sample 3" by the same method as applied to the preparation of toner in Example 1.

EXAMPLE 4

10 g of a monomer mixture that was composed of 70 parts of methyl methacrylate, 15 parts of stearyl methacrylate, and 15 parts of 2-ethylhexyl acrylate and capable of producing a polymer compound of ingredient H having a weight average molecular weight of 280,000 and a glass transition point of 51° C. at the separate state thereof and a monomer mixture that was composed of 90 parts of methyl methacrylate, 5 parts of n-butyl acrylate, and 5 parts of n-butyl methacrylate and capable of producing a polymer compound of ingredient L having a weight average molecular weight of 13,000 and a glass transition point of 68° C. at the separate state thereof were used for polymerization according the method as used in Example 1 to obtain a polymer compound having a weight average molecular weight of 37,000, a ratio Mw/Mn of 5.2, a glass transition point of 63° C. and a softening point of 117° C.

The polymer compound was used for the binder resin to prepare another toner of the present invention or "Sample 4" by the same method as applied to the preparation of toner in example 1.

EXAMPLE 5

30 g of a monomer mixture that was composed of 30 parts of methyl methacrylate and 70 parts of n-butyl methacrylate and capable of producing a polymer compound of ingredient H having a weight average molecular weight of 250,000 and a glass transition point of 43° C. at the separate state thereof and 100 g of a monomer mixture that was composed of 85 parts of styrene and 15 parts of α-methylstyrene and capable of producing a polymer compound of ingredient L having a weight average molecular weight of 4,800 and a glass transition point of 69° C. at the separate state thereof were used for polymerization according to the method as used in Example 1 to obtain a polymer compound having a weight average molecular weight of 61,000, a ratio Mw/Mn of 19.8, a glass transition point of 61° C. and a softening point of 114° C.

The polymer compound was used for the binder resin to prepare another toner of the present invention or "Sample 5" by the same method as applied to the preparation of toner in Example 1.

EXAMPLE 6

A monomer mixture C as formulated in Table 2 was polymerized under the same condition as applied to the first stage of polymerization reaction in Example 1 to obtain a polymer compound having a weight average molecular weight of 240,000 and a glass transition point of 56° C. 30 g of this polymer compound was dissolved in 200 g of toluene in a 1 liter separable flask fitted with a reflux condenser tube and the resultant solution was heated for boiling. A monomer mixture D also formulated in Table 2 was then added dropwise to the boiling solution in a span of time of 4 hrs. Thereafter, the mixture was kept boiling for another 2 hrs to complete the polymerization reaction. The solvent toluene was then evaporated under vacuum for removal to obtain a polymer compound composed of the ingredients L and H. With this polymer compound, the weight average molecular weight Mw was estimated to 59,000, the ratio Mw/Mn to 19.0, the glass transition point to 58° C. and the softening point to 118° C. It is noted that when the monomer mixture D was polymerized alone under the same condition, a polymer compound having a weight average molecular weight of 4,800 and a glass transition point of 59° C. was obtained.

The above polymer compound composed of both ingredients L and H was used for the binder resin to prepare another toner of the present invention or "Sample 6" by the same method as applied to the preparation of toner in Example 1.

TABLE 2

| | Monomer mixture C | Monomer mixture D |
|---|---|---|
| Styrene | — | 95 g (95 parts) |
| Ethyl methacrylate | 40 g (80 parts) | — |
| n-butyl methacrylate | 10 g (20 parts) | — |
| 2-ethylhexyl methacrylate | — | 5 g (5 parts) |
| Benzoyl peroxide | 0.1 g (0.2 parts) | 5 g (5 parts) |

EXAMPLE 7

30 g of a monomer mixture that was composed of 50 parts of styrene and 50 parts of n-butyl methacrylate in formulation and capable of producing a polymer compound of ingredient H having a weight average molecular weight of 210,000 and a glass transition point of 55° C. at the separate state thereof and 100 g of a monomer mixture that was composed of 80 parts of methyl methacrylate and 20 parts of n-butyl methacrylate and capable of producing a polymer compound of ingredient L having a weight average molecular weight of 6,700 and a glass transition point of 56° C. at the separate state thereof were used for polymerization according to the method as used in Example 1 to obtain a polymer compound having a weight average molecular weight of 54,000, a ratio Mw/Mn of 12.4, a glass transition point of 55° C. and a softening point of 115° C.

The polymer compound was used for the binder resin to prepare another toner of the present invention or "Sample 7" by the same method as applied to the preparation of toner in Example 1.

EXAMPLE 8

20 g of a monomer mixture that was composed of 75 parts of styrene and 25 parts of n-butyl acrylate and capable of producing a polymer compound of ingredient H having a weight average molecular weight of 180,000 and a glass transition point of 49° C. at the separate state thereof and 100 g of a monomer composition that was composed of 100 parts of styrene and capable of producing a polymer compound of ingredient L having a weight average molecular weight of 5,400 and a glass transition point of 73° C. were used for polymerization according to the method as used in Example 6 to obtain a polymer compound of a weight average molecular weight of 35,000, a ratio Mw/Mn of 10.7, a glass transition point of 68° C. and a softening point of 121° C.

The polymer compound was used for the binder resin to prepare another toner of the present invention or "Sample 8" by the same method as applied to the preparation of toner in Example 1.

EXAMPLE 9

The monomer mixture A as used in Example 1 was polymerized under the same condition as applied to the first stage of polymerization reaction in the same Example to obtain a higher molecular weight polymer compound "a" while the monomer mixture B was polymerized separately under the same condition as applied to the second stage of polymerization reaction in that Example to obtain a lower molecular weight polymer compound "b". 15 g of the above polymer compound a and 100 g of the above polymer compound b were dissolved together in 300 ml of solvent tetrahydrofuran and after 30 min agitation by a three-one motor for dispersion the solvent was removed by an evaporator to provide a homogenous polymer compound that was composed of the polymer compounds a and b. With this mixed polymer compound, the weight average molecular weight Mw was estimated to 59,000, the ratio Mw/Mn to 6.5, the glass transition point to 65° C. and the softening point to 118° C.

The polymer compound was used for the binder resin to prepare another toner of the present invention or "Sample 9" by the same method as applied to the preparation of toner in Example 1.

COMPARATIVE EXAMPLE 1

50 g of a monomer mixture that was composed of 70 parts of styrene and 30 parts of n-butyl acrylate and capable of producing a polymer compound of ingredient H having a weight average molecular weight of 280,000 and a glass transition point of 34° C. at the separate state thereof and 100 g of a monomer mixture that was composed of 70 parts of styrene and 30 parts of n-butyl methacrylate and capable of producing a polymer compound of ingredient L having a weight average molecular weight of 10,000 and a glass transition point of 56° C. at the separate state thereof were used for polymerization according to the method as used in Example 1 to obtain a polymer compound having a weight average molecular weight of 100,000, a ratio Mw/Mn of 13.6, a glass transition point of 47° C. and a softening point of 106° C.

The polymer compound was used for the binder resin to prepare toner for comparison or "Control 1" by the same method as applied to the preparation of toner in Example 1.

The binder resin of this control sample was composed of a base resin whose glass transition point was lower than 50° C.

COMPARATIVE EXAMPLE 2

50 g of a monomer mixture that was composed of 45 parts of styrene, 10 parts of methyl methacrylate and 45 parts of n-butyl methacrylate and capable of producing a polymer compound having a weight average molecular weight of 210,000 and a glass transition point of 60° C. at the separate state thereof and 100 g of a monomer mixture that was composed of 80 parts of styrene, 10 parts of n-butyl acrylate and 10 parts of n-butyl methacrylate and capable of producing a polymer compound having a weight average molecular weight or 9,300 and a glass transition point of 46° C. at the separate state thereof were used for polymerization according to the method as used in Example 1 to obtain a polymer compound having a weight average molecular weight of 76,000, a ratio Mw/Mn of 11.0, a glass transition point of 52° C. and a softening point of 126° C.

The polymer compound was used for the binder resin to prepare another toner for comparison or "Control 2" by the same method as applied to the preparation of toner in Example 1.

The base resin used for the binder resin of this control sample was composed of an ingredient L whose glass transition point was lower than 50° C.

COMPARATIVE EXAMPLE 3

30 g of a monomer mixture that was composed of 70 parts of styrene and 30 parts of n-butyl methacrylate and capable of producing a polymer compound of ingredient H having a weight average molecular weight of 260,000 and a glass transition point of 73° C. at the separate state thereof and 100 g of a monomer mixture that was composed of 70 parts of styrene and 30 parts of n-butyl methacrylate and capable of producing a polymer compound of ingredient L having a weight average molecular weight of 12,000 and a glass transition point of 58° C. at the separate state thereof were used for polymerization according to the method as used in Example 1 to obtain a polymer compound having a weight average molecular weight of 69,000, a ratio Mw/Mn of 9.0, a glass transition point of 61° C. and a softening point of 148° C.

The polymer compound was used for the binder resin to prepare another toner for comparison or "Control 3" by the same method as applied to the preparation of toner in Example 1.

The binder resin of this control sample was composed of a base resin that contained an ingredient H whose glass transition point was higher than 65° C.

COMPARATIVE EXAMPLE 4

30 g of a monomer mixture that was composed of 80 parts of styrene and 20 parts of n-butyl acrylate and capable of producing a polymer compound having a weight average molecular weight of 310,000 and a glass transition point of 53° C. and 100 g of a monomer mixture that was composed of 80 parts of styrene and 20 parts of n-butyl acrylate and capable of producing a polymer compound of ingredient L having a weight average molecular weight of 15,000 and a glass transition point of 40° C. at the separate state thereof were used for polymerization according to the method as used in Example 1 to obtain a polymer compound having a weight average molecular weight of 83,000, a ratio Mw/Mn of 8.6, a glass transition point of 44° C. and a softening point of 108° C.

The polymer compound was used for the binder resin to prepare another toner for comparison or "Control 4" by the same method as applied to the preparation of toner in Example 1.

For the binder resin of this control sample, both the base resin and ingredient L had a glass transition point lower than 50° C.

COMPARATIVE EXAMPLE 5

20 g of a monomer composition that was composed of 100 parts of styrene and capable of producing a polymer compound of ingredient H having a weight average molecular weight of 180,000 and a glass transition point of 100° C. and 100 g of a monomer mixture that was composed of 70 parts of styrene and 30 parts of 2-ethylhexyl methacrylate and capable of producing a polymer compound of ingredient L having a weight average molecular weight of 12,000 and a glass transition point of 43° C. at the separate state thereof were used for polymerization according to the method as used in Example 6 to obtain a polymer compound having a weight average molecular weight of 40,000, a ratio Mw/Mn of 5.6, a glass transition point of 53° C. and a softening point of 136° C. polymer compound having a weight average molecular weight of 57,000, a ratio Mw/Mn of 10.5, a glass transition point of 45° C. and a softening point of 123° C.

The polymer compound was used for the binder resin to polymer compound having a weight average molecular weight of 57,000, a ratio Mw/Mn of 10.5, a glass transition point of 45° C. and a softening point of 123° C.

The polymer compound was used for the binder resin to prepare another toner for comparison or "Control 6" by the same method as applied to the preparation of toner in Example 1.

For the binder resin of this control sample, both the base resin and its ingredient L had a glass transition point that was lower than 50° C. while the ingredient H had a glass transition point higher than 65° C.

COMPARATIVE EXAMPLE 7

10 g of a monomer mixture which was composed of 50 parts of styrene, 20 parts of methyl methacrylate and 30 parts of butyl methacrylate and capable of producing a polymer compound having a weight average molecular weight of 360,000 and a glass transition point of 73° C. at the separate state thereof and 100 g of a monomer mixture that had the same formulation as used for the ingredient H and capable of producing a polymer compound having a weight average molecular weight of 16,000 and a glass transition point of 61° C. at the separate state thereof were used for polymerization according to the method as used in Example 1 to obtain a polymer compound having a weight average molecular weight of 48,000, a ratio Mw/Mn of 5.4, a glass transition point of 62° C. and a softening point of 136° C.

The polymer compound was used for the binder resin to prepare another toner for comparison or "Control 7" by the same method as applied to the preparation of toner in Example 1.

For the binder resin of this control sample, the ingredients H and L of which the base resin was composed used the same formulation and the former ingredient had a glass transition point higher than 65° C.

4 parts of toner taken from each of Samples 1 to 9 and Controls 1 to 7 was mixed with 96 parts of iron powder carrier having a mean grain size of about 50 to 80u to prepare 16 types of developer in total. They were used to conduct a fixing performance test and cohesion test.

In the fixing test, toner images were developed from electrostatic latent images formed by the ordinary electrophotographic process using each type of developer and they were transferred on to individual copy papers. Each copy paper with an image thereon was then subjected to a fixing step by passing it across a fixing device comprising a pair of rolls, namely a hot roll whose surface was coated with polytetrafluoroethylene or teflon (supplier: Du Pont) and a pressure roll whose surface was coated with silicon rubber KE-1300 R.T.V. (supplier: Shinetsu Chemical Industry), at a linear speed of 150 m/sec with the temperature of hot roll set to various levels. For individual types of developer made from Samples and Controls, the lower limit to temperatures at which toner images could be fixed by the hot roll was thus estimated. The results are given in Table 3.

On the other hand, in the cohesion test, the Samples and Controls were put into individual containers and left to stand for 24 hours at an ambient temperature of 40° C. The results are also given in Table 3.

TABLE 3

| Toner in developer | Lower limit to temp. (°C.) at which fixing occurred | Cohesion |
|---|---|---|
| Sample 1 | 145 | None |
| Sample 2 | 140 | None |
| Sample 3 | 135 | None |
| Sample 4 | 140 | None |
| Sample 5 | 135 | None |
| Sample 6 | 140 | None |
| Sample 7 | 135 | None |
| Sample 8 | 145 | None |
| Sample 9 | 140 | None |
| Control 1 | 130 | Detected |
| Control 2 | 150 | Detected |
| Control 3 | 170 | None |
| Control 4 | 130 | Detected |
| Control 5 | 160 | Detected |
| Control 6 | 145 | Detected |
| Control 7 | 160 | None |

The results in Table 3 clearly indicate that toner samples of the present invention gave a lower estimate for the lower limit to temperatures at which fixing occurred and they showed no cohesion. By contrast, toner of Controls 1, 4 and 6 was of no practical use since it showed cohesion because of a low glass transition point of the base resin used for its binder resin. Further, toner of Controls 3, 5 and 7 had a higher estimate for the lower limit to temperatures at which fixing occurred since the base resin of its binder resin had a higher softening point because of a higher glass transition point of ingredient H the base resin contained while toner of Controls 2 and 5 showed cohesion being of no practical use since though the base resin of its binder resin had a higher glass transition point the ingredient L had a glass transition point that was too low.

We claim:

1. Toner for developing an electrostatic latent image, comprising a binder resin and a coloring agent being dispersed therein, said binder resin comprising, as the main resin component, a lower molecular weight polymer ingredient and a higher molecular weight polymer ingredient, each of which polymer ingredients are respectively composed of one or more polymers selected from a group consisting of a styrene polymer, an acrylic polymer and a stylene-acrylic copolymer but are different from each other, provided that said lower molecular weight polymer ingredient and said higher molecular weight polymer ingredient have a glass transition point of 50° C. or over and 65° C. or under respectively, while said main resin component as a whole has a glass transition point of 50° C. or over.

2. The toner according to claim 1, wherein the ratio of the weight average molecular weight of said main resin component to the number average molecular weight thereof is 3.5 or more.

3. The toner according to claim 1, wherein said lower molecular weight polymer ingredient and said higher molecular weight polymer ingredient have a weight average molecular weight of 50,000 or less and 80,000 or more, respectively.

* * * * *